US005613334A

United States Patent [19]

Petrina

[11] Patent Number: 5,613,334

[45] Date of Patent: Mar. 25, 1997

[54] LAMINATED COMPOSITE REINFORCING BAR AND METHOD OF MANUFACTURE

[75] Inventor: Petru Petrina, Ithaca, N.Y.

[73] Assignee: Cornell Research Foundation, Inc., Ithaca, N.Y.

[21] Appl. No.: 496,931

[22] Filed: Jun. 30, 1995

Related U.S. Application Data

[63] Continuation-in-part of Ser. No. 356,658, Dec. 15, 1994, abandoned.

[51] Int. Cl.[6] ..... E04L 5/08

[52] U.S. Cl. ..... 52/223.1; 52/740.1; 52/223.5; 52/DIG. 7; 52/DIG. 8

[58] Field of Search ..... 52/223.1, 223.5, 52/236.5, 405.3, DIG. 7, DIG. 8, 740.1, 740.4, 740.8, 740.9, 223.8, 223.11; 428/320.2, 322.2, 36.9, 188

[56] References Cited

U.S. PATENT DOCUMENTS

| | | | |
|---|---|---|---|
| 2,372,048 | 3/1945 | Auxier | 52/DIG. 7 X |
| 2,425,883 | 8/1947 | Jackson | 52/DIG. 7 X |
| 2,609,586 | 9/1952 | Parry | 52/DIG. 7 X |
| 2,836,529 | 5/1958 | Morris | 52/DIG. 7 X |
| 4,300,321 | 11/1981 | Preis et al. | 52/740.1 X |
| 4,694,622 | 9/1987 | Richard | 52/223.5 |
| 5,202,186 | 4/1993 | Williamson | 428/36.9 X |
| 5,264,262 | 11/1993 | Igarashi | 428/36.9 |
| 5,534,318 | 7/1996 | De La Porte et al. | 428/36.9 |

*Primary Examiner*—Carl D. Friedman
*Assistant Examiner*—W. Glenn Edwards
*Attorney, Agent, or Firm*—Barnard, Brown & Michaels

[57] ABSTRACT

The invention presents a non-metallic laminated composite reinforcing rod for use in reinforced or prestressed concrete. The rod is made by creating a sheet of core material comprising a number of layers of "pre-preg" material. Ribs are formed on top of the core from additional layers of pre-preg material laid with the fibers transverse to those in the core. The ribs are then covered by additional layers of pre-preg laid with fibers parallel to the core fibers. The material is heated to fuse the layers. Finally, the sheets of laminated reinforcement are cut parallel to the core fibers to the width desired. The resulting reinforcing rod is superior to steel in corrosion resistance, flexibility, durability, and strength. The reinforcing rod may be used as a prestressing tendon in prestressed concrete after encasing the ends of the rod in an attachment formed of a sleeve filled with groutingmaterial such as mortar or epoxy. The glass-fiber embodiment is non-conductive. If carbon prepreg made of high modulus fibers is used, then the Young modulus of the LCRs is approximately equal to that of steel.

21 Claims, 5 Drawing Sheets

Fig. 7 Stress - Strain Curve

LAMINATED COMPOSITE REINFORCING BAR AND METHOD OF MANUFACTURE

REFERENCE TO RELATED APPLICATIONS

This application is a continuation-in-part of application Ser. No. 08/356,658, filed Dec. 15, 1994 now abandoned.

FIELD OF THE INVENTION

The invention pertains to the field of reinforced concrete. More particularly, the invention pertains to non-metallic reinforcement for reinforced or prestressed concrete.

BACKGROUND OF THE INVENTION

Cement is a material with adhesive and cohesive properties that make it capable of bonding mineral fragments into a compact whole. The cement most commonly used in civil engineering and building is Portland cement. Concrete is produced by intimately mixing cement, water, fine aggregate (sand), and coarse aggregate (gravel). The mixture is then placed in forms, compacted thoroughly, and allowed to harden.

Concrete is strong under compression, but relatively low in strength under tension. When a structural member such as a beam is made of concrete, it is under both compressive stress at the top of the beam and tension at the bottom of the beam. Thus, a concrete beam would tend to fail by being cracking and pulling apart at the bottom, where the stress is tensile. The same is true of concrete roads, or any other application where tensile forces will be applied to concrete.

This can be overcome by placing reinforcement where it is necessary for structural members to resist tensile forces. The result is called "reinforced concrete." The reinforcement is typically in the form of steel bars (usually called "reinforcing bars" or simply "rebars") or welded wire fabric (in the case of flat areas such as roads, floors, or other concrete slabs).

In a concrete beam, the steel rebar is placed in the lower part of the beam, so that the tensile forces are countered by the reinforcement. The steel reinforcement is bonded to the surrounding concrete so that stress is transferred between the two materials.

In a further development the steel is stretched before the development of bond between it and the surrounding concrete. When the force that produces the stretch is released, the concrete becomes precompressed in the part of the structural member that is normally the tensile zone under load. The application of loads when the structure is in service reduces the precompression, but generally tensile cracking is avoided. Such concrete is known as "prestressed concrete".

There are a number of drawbacks to steel reinforcement in concrete construction, at least in certain applications.

The durability of concrete structures, in corrosive environments such as bridge beams and decks and parking garage floors, is determined by the life of the reinforcement steel. In the snowy Northeast, the salt applied to roads in the winter leaches into the concrete and causes the reinforcing bars to rust away. This has resulted in the need for massive road reconstruction in recent years, as the road and bridge slabs poured in the construction of the Interstate Highway System in the 1960's begin to crack and fail all over the Northeast. The safety implications for reinforced concrete used in beams and decks in road bridges and parking structures are frightening.

In other applications, the steel in conventional reinforced concrete may be a problem. Magnetically levitated (MagLev) trains depend on strong magnetic fields and linear induction motors which may be disrupted by metallic reinforcing in supporting beams.

There have been several attempts in the past at replacing steel reinforcing bars with bars which are partly or entirely made of non-metallic materials. These have, in general, resulted in round reinforcements made of continuous fibers such as carbon, aramid or glass in resin, which resemble the traditional steel rebars. Because of the failure of the concrete to adhere properly to the plastic reinforcement, the rebars are commonly wrapped in spirals of additional plastic material to provide something for the concrete to grip. This has not been entirely successful, for several reasons: the helical wrapping or rings intended to provide grip tend to slip along the length of the rebar; the lack of a secure method of anchoring the reinforcement; and, if the external helical wrapping is stressed so that indentations occur, these indentations create sharp kinks in the longitudinal fibers initiating failure; in a pultrusion process, as the diameter increases, the strength of the resulting bar is reduced due to non-uniform curing across the bar.

L'Esperance, et al., U.S. Pat. No. 4,620,401, is typical of these earlier non-metallic reinforcing bars. The bar is formed by a process called "continuous pultrusion", whereby the fibers are drawn through a bath of resin, wrapped with the spiral fibers for mechanical adhesion to the concrete, sprayed with more resin, and cut to length. Pultrusion poses problems for reinforcing bars because of non-uniform strength because of non-uniform wetting of the fibers and curing of the resin. As the diameter increases the strength per unit area tends to decrease. L'Esperance has outside "embossments", corresponding to the transverse ribs of the present invention. Without the cover plies of the present invention, these "embossments" will tend to slide along the bar when put under stress.

Goldfein, U.S. Pat. No. 2,921,463, is a glass fiber reinforcement for concrete which has no ribs or other means to increase adhesion with the concrete. The glass fibers are bound with a resin which is still wet when the fibers are placed in the concrete, or in a separate operation, cement is applied to the wet resin to create a primer to which the concrete can bond.

Abbott, U.S. Pat. No. 3,167,882, is a method of prestressing concrete. A rod made of two parts of different materials, bonded with a bonding agent which can be destroyed by heat. The core part, made an electrically conductive material such as steel or cast iron, is prestressed in compression. Layers of a material having a high tensile stress, such as a suitable steel alloy or fiberglass, are bonded to the sides of the core while the core is under compression. After the bonding is complete, the compression in the core is released, and the compressive force becomes a tension in the side layers. The rod is set into the concrete and after the concrete cures an electrical current is passed through the core, heating it and releasing the bond between the core and the side layers.

SUMMARY OF THE INVENTION

The invention presents a non-metallic laminated composite reinforcing rod for use in reinforced or prestressed concrete.

The rod is made by creating a sheet of core material comprising one or more layers of synthetic fibers such as glass, graphite or aramid fibers, laid parallel in a heat-settable resin—this material is commercially avaliable in sheets or rolls as "pre-preg" material. Ribs are formed on both faces of the core from additional layers of pre-preg material laid with the fibers transverse to those in the core. The ribs are then covered by one or more additional layers of pre-preg laid with fibers parallel to the core fibers. The material is heated and pressed to fuse the layers. Finally, the sheets of laminated reinforcement are cut parallel to the core fibers to the width desired.

The resulting reinforcing rod is superior to steel in corrosion resistance, durability, deformation rebound characteristics, and strength per pound. The glass-fiber embodiment is non-conductive.

The reinforcing rod may be prestressed by encasing the ends of the rod in an attachment formed of a cylindrical sleeve filled with groutingmaterial.

DESCRIPTION OF THE PREFERRED EMBODIMENT

Figure 1:
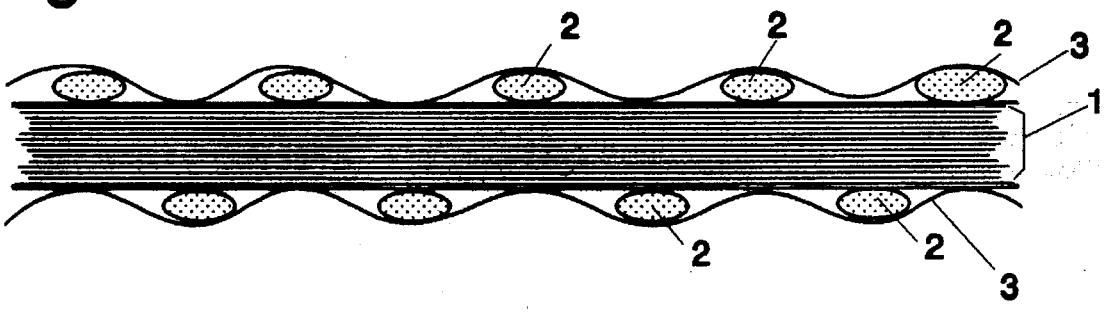
FIG. 1 shows a cross-section of a reinforcing rod made according to the invention

FIG. 1 shows a laminated composite reinforcing (LCR) made according to the teachings of the invention.

Prepreg Material

The bar is built up from multiple layers of "prepreg". "Prepreg" materials comprise reinforced plastic composites of high-strength fibers in a heat curable resin base, formed into sheets or rolls of flat material. The fibers can be unidirectional (i.e. all of the fibers run along the roll/sheet in the same direction) or cross-plied (the fibers are arranged along and across the sheet in a grid), and are preferably of synthetic materials. Two prepreg materials have been used in testing the invention.

The glass fiber preferred prepreg material for the LCR bar of the invention is Scotchply® Reinforced Plastic, Type SP-250-S29, manufactured by Minnesota Mining and Manufacturing Company. Scotchply® prepreg is a high structural strength fiber reinforced plastic molding material sold in the form of fibers containing uncured resin. It is available in rolls from ½" to 45" in width by up to 72 yards in length, and has a cure temperature of 250° F. (121° C.). It may be used structurally under temperatures ranging from −65° F. to 250° F. (−54° C. to 121° C.). The fibers are Owens-Coming S2-449 glass.

If carbon-fiber (graphite) reinforcing is desired, then Hercules® Carbon Prepreg Tape AS4/3501-6, manufactured by Hercules Advanced Materials and Systems Company, is the preferred material. The reinforcements are Hercules continuous type AS4 carbon filaments, surface-treated to increase the composite shear and transverse tensile strength, in Hercules 3501-6 resin. It comes in a 12" or larger width, and has a maximum 350° F. (177° C.) cure temperature.

Example of LCR

The number of plies and dimensions of the LCR in the following description is for a 0.4"–0.5" thick glass-reinforced bar with a square cross-section, which is equivalent in strength to a number 8 (i.e. 1" diameter bar) grade 60 steel reinforcing bar. It will be understood that the number of plies and bar width can be varied within the teachings of the invention to produce LCRs equivalent to other standard steel rebars.

It should be noted that the examples given in this specification all show a core made up of multiple layers of pre-preg, because the commercially available pre-preg material listed in the examples, which was used in the prototype bars, is manufactured in relatively thin layers. This conforms to current practice in manufacture of stock pre-preg materials. However, it is anticipated that in the future the material could be made available in thick sheets, which would allow a single thick layer of fibers in resin to be used for the core in place of the multiple thinner layers. Similarly, the cover plies could be made of a single thick layer, if such material becomes available.

The core (1) of the bar is made up of 32 layers of unidirectional Scotchply® prepreg material. The plies are laid down with the fibers parallel along the length of the intended bar.

Transverse ribs (2) are located above and below the core layers (1), running transverse to and across the entire width of the core (1). These are preferably arranged alternately, as shown, although they could also be arranged one above the other. The ribs are preferably 0.4" to 0.8" apart. They are formed of prepreg material, with the fibers oriented transverse to the fibers of the core. Suitable ribs can be made of a 6" width of prepreg, rolled tightly. The ribs are preferably arranged perpendicular to the core plies, but could be at an angle to the core plies if desired or required for manufacturing purporses. It is anticipated that the transverse ribs could diverge from the perpendicular by as much as 45° without affecting the performance of the bar.

The transverse ribs (2) on each side of the core are covered by 4 face plies (3) of unidirectional prepreg material, with the fibers oriented in the same direction as the core layers (1). The resulting rebar is 40 plies (approximately 0.40") thick, and is cut to approximately ½" width.

The combination of core (1), ribs (2) and cover (3) plies causes the LCR of the invention to exhibit a "pseudo-negative Poisson" characteristic. That is, conventional rebars will show Poisson behavior—they become thinner as stress is applied, weakening the bond between bar and concrete. The LCR bar of the invention acts in the opposite fashion. As tension is applied to the bar, the cover plies (3) try to stretch parallel to the core plies (1). Thus, the cover (3) between the ribs (2) is forced outward from the core (1), effectively increasing the thickness of the bar and increasing the bond of the bar to the concrete in which it is encased.

Performance of Reinforced Beams Using the Invention

Figure 2:
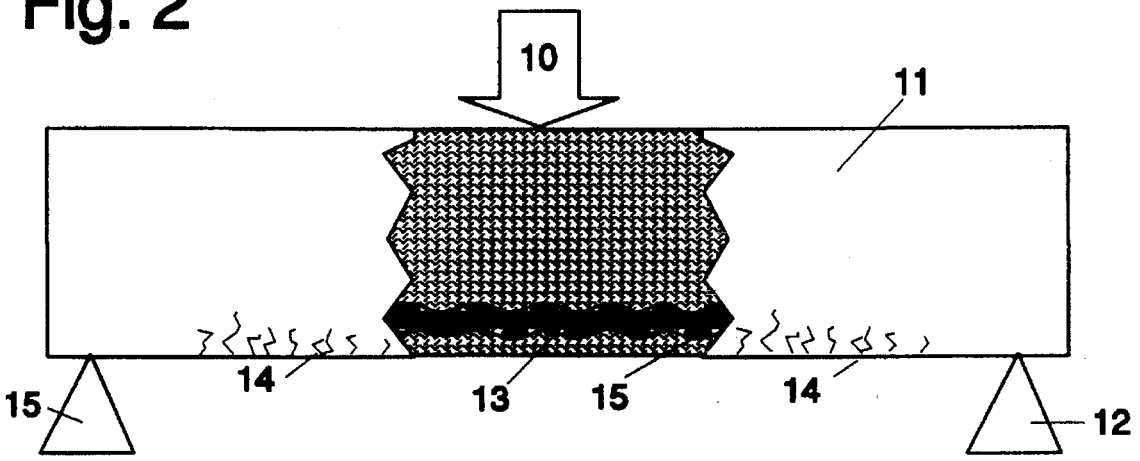
FIG. 2 shows a side view of a concrete beam using the reinforcing rod of the invention, with a cut-away to show the rods.
Figure 3:
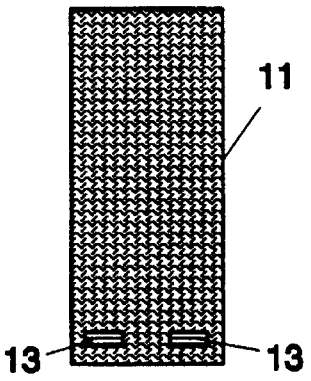
FIG. 3 shows an end view of a concrete beam using two reinforcing rods of the invention as reinforcement.

FIGS. 2 and 3 show side and end views, respectively, of a concrete beam (11) reinforced by two LCR bars (13) of the invention. Under test conditions, the beam (11) is supported near its ends by supports (12) and (15), and a force (10) is applied to the center. The rebars, as is conventional, are placed near the bottom of the beam, so as to reinforce the beam against the tensional forces present at the bottom of the beam.

After testing, the beam shows cracking (14) from the bottom of the beam, as would be expected. It is desirable to have numerous small cracks under these test conditions, which shows that the reinforcing is performing correctly. Experiments have shown that the LCR of the invention creates just such a condition, with the small cracks related to the location of the transverse ribs (15). The testing has also shown that a concrete beam reinforced by LCRs of the invention made from fiberglass prepreg will bend significantly more without failure than one reinforced by conventional steel rebars.

While the strength of the LCR bar is approximately the same as a standard steel rebar four times its thickness (diameter), it is considerably less stiff. The modulus of elasticity (E) of a steel rebar is approximately $29\times10^6$ psi, while that of the glass composite rebar described above is approximately $7\times10^6$ psi. If graphite prepreg were used, the stiffness would be about 75% of steel ($E=21.5\times10^6$ psi).

Prestressed Concrete

In the past, it was difficult to use non-metallic reinforcing bars in prestressed applications because of problems with gripping the bar in the first instance, and of adhesion between the bar and the concrete. The LCR bar of the invention can be used in prestressed concrete applications, using a novel end attachment to grip and anchor the ends of the rebar.

Figure 5:
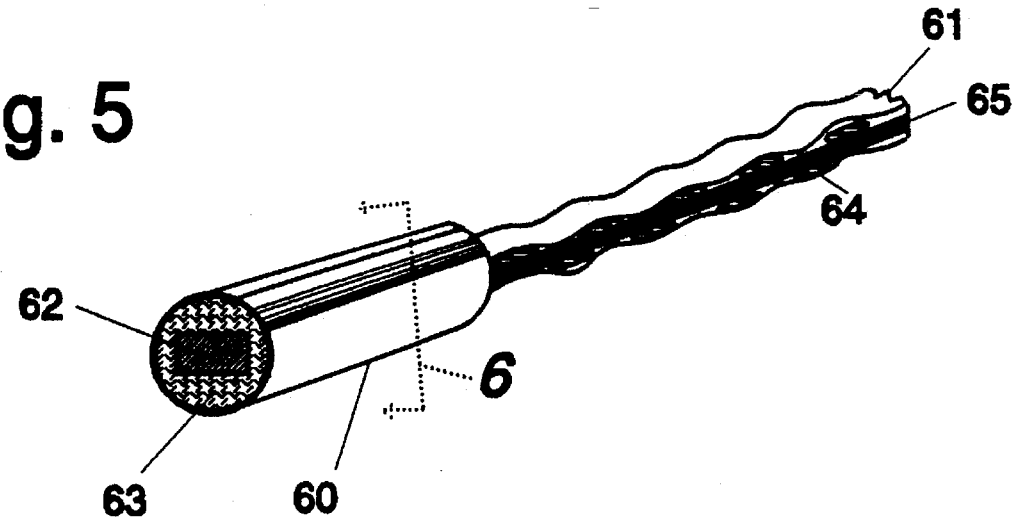
FIG. 5 shows an end attachment (anchorage) for use with the invention, allowing secure gripping of the bar in prestressed applications.
Figure 6:
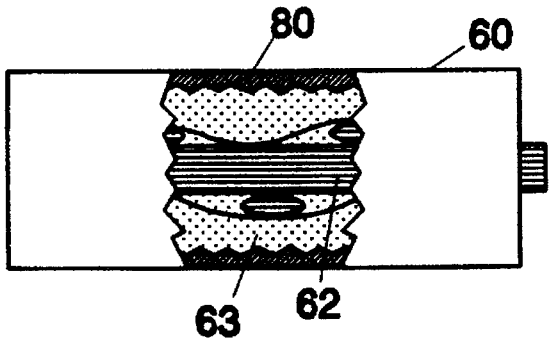
FIG. 6 shows a cut-away detail of the inside of the cylindrical sleeve from FIG. 5.

FIG. 5 shows a detail of the end of a length of the LCR of the invention (62). As shown and discussed earlier, the combination of core (65), transverse ribs (64) and cover plies (61) allows the bar to bond to the concrete in which the rebar is encased, developing up to 100% of its tensile strength.

The end attachment is made up of a cylindrical or conical sleeve (60), into which the rebar (62) is inserted. The sleeve is long enough to encase a number of the transverse ribs (64) above and below the core (65), and may be made of steel or aluminum or other material. Because of the high bond transferred by friction and bearing on the ribs, the development length (that is, how far the bar must be embedded to develop sufficient strength) would be relatively short.

If desired, the inner surface of the sleeve (60) can be threaded (80) as shown in the cutaway detail in FIG. 5.

The sleeve (60) is then filled with anchoring mortar (63). Anchoring mortar, made of anchoring cement manufactured by Miniwax company, inc., has been found to be preferred for this application. When the mortar (63) sets, the bond between the rebar (62) and the sleeve (60) is excellent, and the sleeve (60) may be gripped and used to apply a tension force to the rebar for use in prestressed concrete. However, for large cross-section bars it has been found that a composite-based epoxy may be preferred as the grouting material, as it has better resistance to the shear stress developed between the bar and the sleeve.

It should be noted that a similar attachment means can also be used to provide a splice between two pieces of reinforcing bar, if additional length is required. In such an application, the ends of the two pieces of LCR are inserted into the ends of a sleeve, and the sleeve is filled with groutingmaterial. When the grouting material sets, a solid splice is formed between the two bars.

Method of Manufacture of the Laminated Composite Reinforcing Bar

FIGS. 4*a*–4*e* shows the steps of the method of manufacturing the LCR of the invention. The dimensions are for the example LCR described above, using Scotchply® glass-fiber prepreg to produce an LCR of approximately ½" in thickness.

Figure 4A:
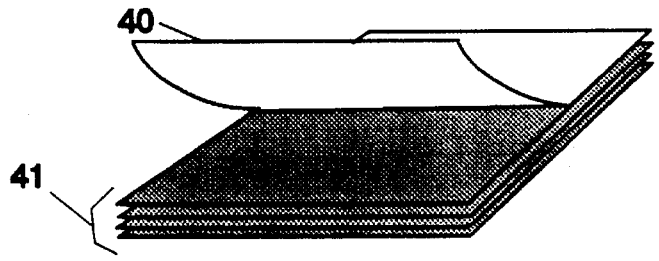
FIGS. 4*a*–4*e* shows the steps of the method of making the reinforcing rod of the invention.

FIG. 4*a:* First, the core layers (41) are laid up, by adding additional layers (40) of unidirectional prepreg sheets until the desired thickness is achieved. The prepreg is laid with the fibers in each new layer oriented parallel to those in the earlier layers. For example, the number of core layers for a ½" thick bar, using Scotchply® glass-fiber prepreg, would be 32 plies. As noted above, if pre-preg material of sufficient thickness is available, the core could be made of a single sheet of pre-preg of appropriate thickness.

Figure 4B:
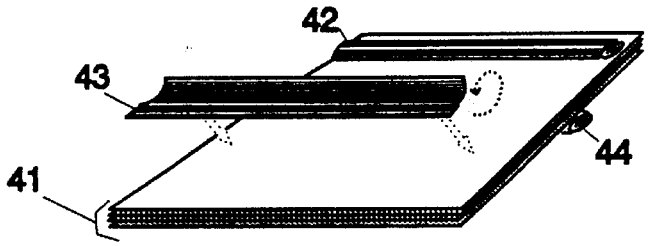

FIG. 4*b:* The transverse ribs are made of 6" wide strips of prepreg (43), rolled tightly and laid across the core layers (41), top (42) and bottom (44).

Figure 4C:
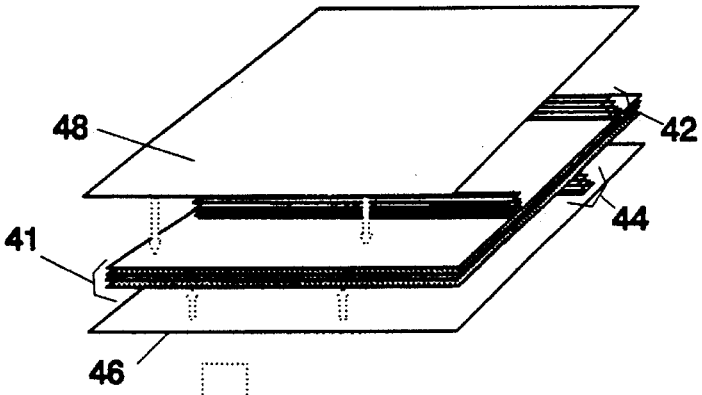

FIG. 4*c:* Cover plies (46) and (48) are laid over the upper (42) and lower (44) transverse ribs. At least one layer on each side is required. Four layers of unidirectional prepreg material would be adequate for the LCR of the example, although this could be varied if desired.

It should be noted here that the proportion between the number of core layers (40), size and spacing of the transverse ribs (42) and (44), and the number of cover plies (46) and (48) interact to determine the tensile stress-strain curve (ductility) of the bar. Preliminary test results have shown that the ratio of core plies to cover plies is inversely proportional to ductility: As the number of core plies is increased relative to the number of cover plies, the ductility is decreased. As the ribs are made larger, and/or offset more, the ductility is increased (that is, the ductility is minimized if the ribs on opposite sides of the core are aligned with each other, maximized if each rib is positioned equidistant between two ribs on the opposite side).

Figure 4D:
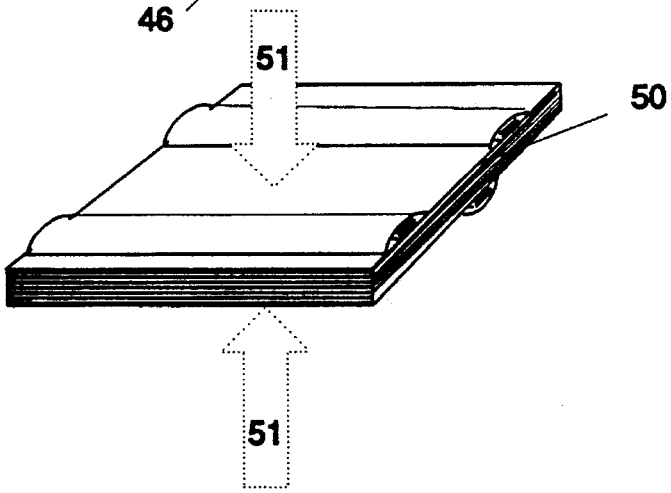

FIG. 4*d:* The prepreg material is bonded. The exact details of the bonding will vary based upon the exact prepreg material selected, and are specified by the manufacturer of the prepreg. Generally, the sheet of laminated material (50) is subjected to heat and pressure (51) for a period of time sufficient to bond all of the layers together into a strong laminated composite.

For Scotchply® glass fiber prepreg material the sheet of laminate is heated to approximately 250° F. (120° C.) under a vacuum pressure of approximately 12 PSIg for a period of approximately 3 hours. The Hercules® graphite prepreg material is cured in a vacuum bag for about 1 hour at a temperature of 240° F., then for 2 hours at 350° F. Both types of material can be cured much faster if they are placed in an autoclave at higher pressure.

Figure 4E:
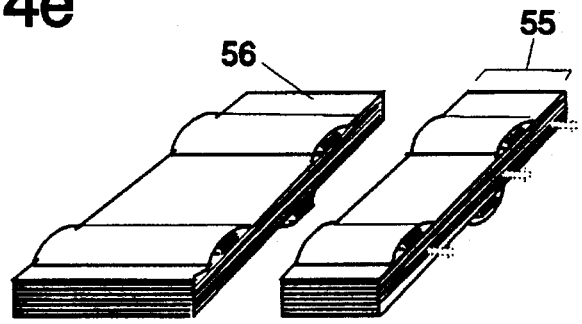

FIG. 4*e:* When the sheet of laminate (56) has cooled, strips of the desired width (55) may be cut off. The fact that the laminate (56) is laid up in relatively wide sheets and is then cut to width allows the production of rectangular or square LCRs of any desired dimensions for the application.

If desired, a bond-enhancing material, preferably in powdered form, such as sand, can be applied to the outside of the cover layers before they are cured. This enhances the bonding of the bar to the concrete, or to the anchorage sleeve, if used.

Alternate Methods of Manufacture

Figure 8:
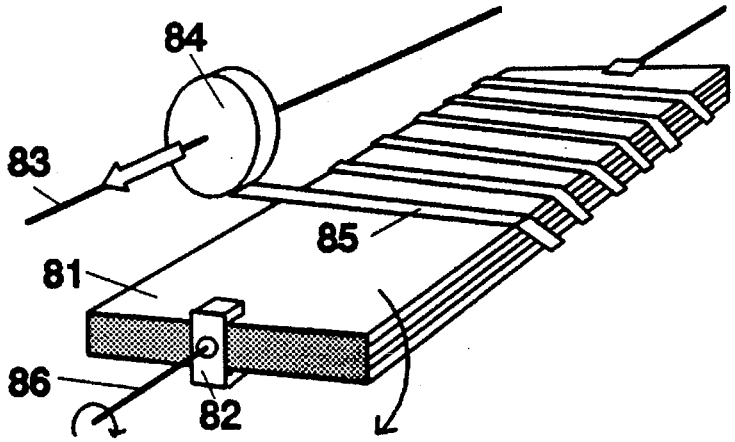
FIG. 8 shows an alternate method of applying the transverse ribs to the core.
Figure 9:
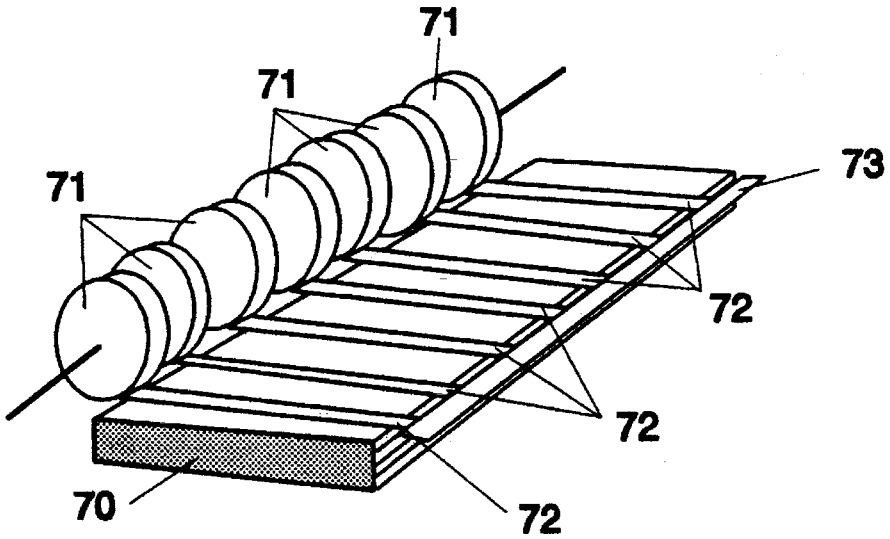
FIG. 9 shows another alternate method of applying the transverse ribs to the core.

For mechanized manufacture, it may be undesireable to individually apply the transverse ribs to the core material. FIGS. 8 and 9 show two alternate methods of applying the transverse ribs which could be used in commercial manufacture of the reinforcing bar of the invention.

In FIG. 8, the core sheet (81), either made of a single thick layer of fibers in resin or fabricated from a number of thinner layers, is mounted on a shaft (86) for rotation using a set of clamps (82). The fibers of the core sheet are parallel to the shaft (86). The core sheet (81) is rotated by the shaft (86).

A roll (84) of prepreg material for the transverse ribs (85) is then wrapped around the core sheet (81) by the rotation of the core sheet (81) on the shaft (86). By moving the roll (84) evenly along a shaft (83) parallel to the shaft (86) on which the core sheet (81) is mounted, the transverse ribs (85) are evenly spaced across the core sheet (81) in a slightly diagonal fashion.

Once the roll (84) reaches the end of the core sheet (81), the rib material is severed, and the core sheet (81) is covered by the cover layers to complete the fabrication of the overall sheet. After heat and pressure fusing, the individual reinforcing rods are cut longitudinally from the sheet.

FIG. 9 shows an alternate method of machine fabrication, in which there are a plurality of rolls (71) of prepreg material for the transverse ribs (72). The materials are drawn out in parallel and laid across the core sheet (70). This can be done by a longitudinal clamp/knife (73). The clamp/knife can be arranged to grab the plurality of ribs in front of the rolls and draw them across the core, then a second clamp/knife grips the material near the rolls and trims it to width.

If desired, the core material (70) can be rotated to cover both sides, as used in FIG. 8, or two sets of rolls can be used to lay transverse ribs (72) on the top and bottom of the core simultaneously.

The overall sheet is then completed with cover layers and slicing as discussed above.

Comparative Stress-Strain Curves

Figure 7:
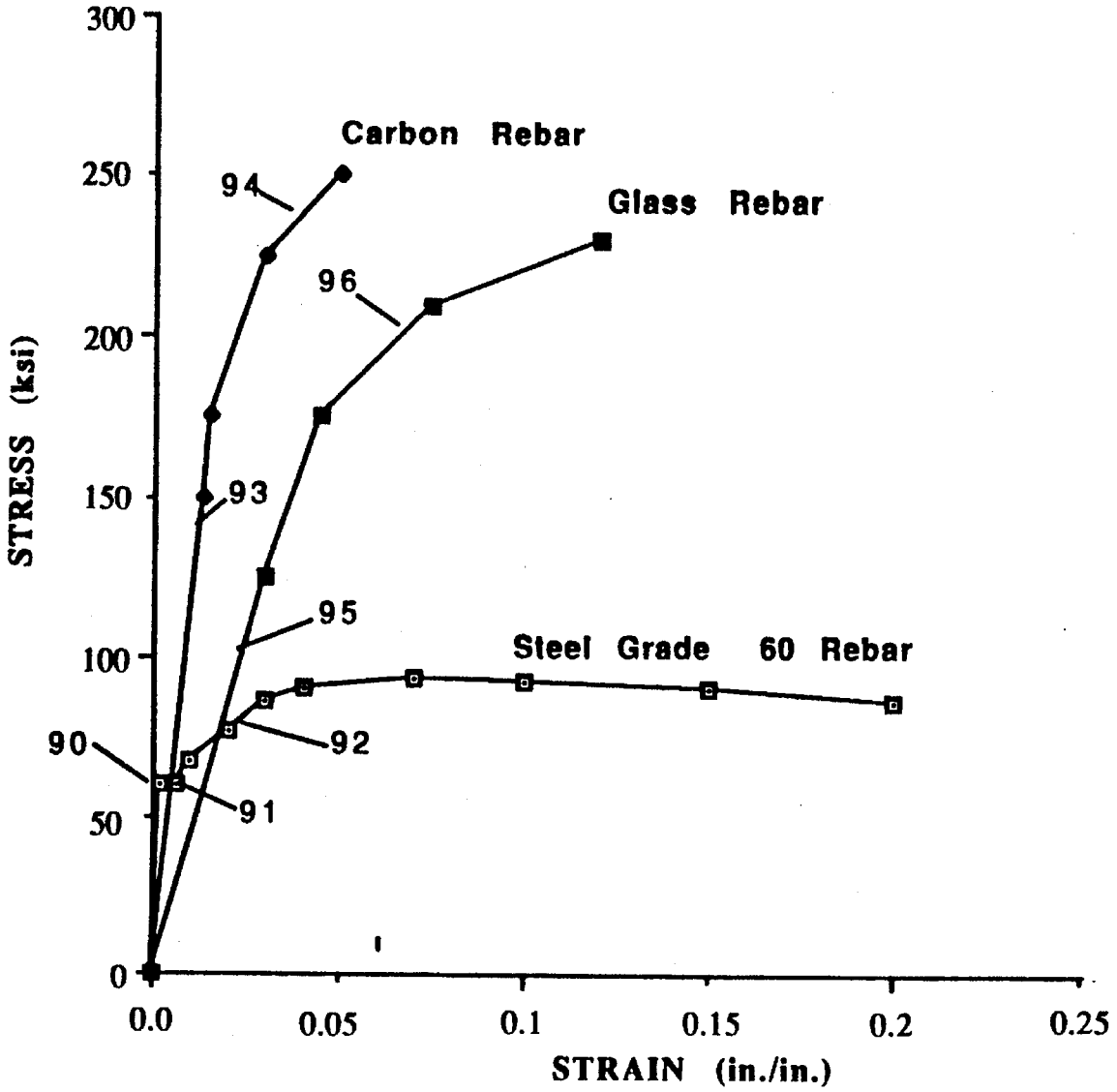
FIG. 7 shows a graph of comparative stress-strain curves for the fiberglass and graphite embodiments of the invention, compared to conventional steel rebar.

FIG. 7 shows graphically a comparison of the LCR bars of the invention with standard steel bars while subjected to tension forces up to the rupture.

Conventional grade 60 Steel rebar is represented by the dashed line in the figure. As can be seen, the material reacts linearly to increasing stress (90) until it reaches approximately 60 KSI, at which point the steel rebar begins to "yield" (91), up to about 0.015 strain. At that point (92), its strength slightly increases, a process called "stress hardening". After significant stretching, the bar will fail at about 0.2 strain.

In contrast, the stress in the rebars made of carbon prepreg, represented by the solid line, increases linearly (93) up to about 0.015 strain. Then, the behavior becomes nonlinear (94) until the rebar fails at about 0.07 strain. The exact point of failure depends upon the combination of core, ribs and cover plies, as discussed above.

Similarly, the rebars made of glass fiber prepreg, represented by the dotted line, increase linearly (95) up to about 0.03 strain. Then, the behavior is nonlinear (96), until the rebar fails at approximately 0.12 strain, depending upon the combination of core, ribs and cover plies, as discussed above.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. A laminated composite reinforcing rod comprising:

a) a core having a top and a bottom and a length, comprising at least one core layer comprising a plurality of fibers in a resin matrix, the fibers being oriented unidirectionally along the length of the core;

b) cover layers located on the top and bottom of the core, each layer comprising a plurality of fibers in a resin matrix, the fibers being oriented unidirectionally parallel the length of the core; and c) a plurality of transverse ribs between the cover layer and the core, each rib comprising a plurality of fibers in a resin matrix, the ribs being oriented transverse to the length of the rod;

wherein the core, ribs and cover layers are bonded together.

2. The laminated composite reinforcing rod of claim 1, in which the core layers, cover layers and transverse ribs are made of layers of prepreg material.

3. The laminated composite reinforcing rod of claim 2, in which the core layers and cover layers are made of layers of unidirectional prepreg material.

4. The laminated composite reinforcing rod of claim 2, in which the transverse ribs are made of rolled strips of prepreg material.

5. The laminated composite reinforcing rod of claim 1, in which the core layers, cover layers and transverse ribs are made of layers of prepreg material.

6. The laminated composite reinforcing rod of claim 1, in which the fibers are synthetic material.

7. The laminated composite reinforcing rod of claim 6, in which the fibers are glass fibers.

8. The laminated composite reinforcing rod of claim 6, in which the fibers are graphite fibers.

9. The laminated composite reinforcing rod of claim 1, in which the transverse ribs are located both on the top and the bottom of the core.

10. The laminated composite reinforcing rod of claim 9, in which the transverse ribs are alternated on the top and the bottom of the core.

11. The laminated composite reinforcing rod of claim 1, further comprising end attachment means, comprising:

a) a sleeve surrounding an end of the rod, creating a space between the rod and the inner surface of the cylindrical sleeve;

b) grouting material filling the space between the inner surface of the cylindrical sleeve and the rod.

12. The laminated composite reinforcing rod of claim 11, in which the inner surface of the sleeve of the end attachment means is threaded.

13. The laminated composite reinforcing rod of claim 11, in which the grouting material is mortar.

14. The laminated composite reinforcing rod of claim 11, in which the grouting material is epoxy.

15. A reinforced concrete structure comprising a concrete body having a plurality of laminated composite reinforcing rods contained therein, each rod comprising:

a) a core having a top and a bottom and a length, comprising at least one core layer comprising a plurality of fibers in a resin matrix, the fibers being oriented unidirectionally along the length of the core;

b) cover layers located on the top and bottom of the core, each layer comprising a plurality of fibers in a resin matrix, the fibers being oriented unidirectionally parallel the length of the core; and c) a plurality of transverse ribs between the cover layer and the core, each rib comprising a plurality of fibers in a resin matrix, the ribs being oriented transverse to the length of the rod;

wherein the core, ribs and cover layers are bonded together.

16. The reinforced concrete structure of claim 15, in which the rods are tensioned to create prestressed concrete.

17. The reinforced concrete structure of claim 16, in which the rods are pre-tensioned.

18. The reinforced concrete structure of claim 16, in which the rods are post-tensioned.

19. The reinforced concrete structure of claim 15, in which the rods further comprise end attachments on each end, each end attachment comprising:

a) a sleeve surrounding an end of the rod, creating a space between the rod and the inner surface of the cylindrical sleeve;

b) grouting material filling the space between the inner surface of the sleeve and the rod;

such that the rods may be tensioned by pulling outward along the length of the rod by means of tension means gripping the outside surface of the sleeves of the end attachments.

20. The reinforced concrete structure of claim 19, in which the grouting material is mortar.

21. The reinforced concrete structure of claim 19, in which the grouting material is epoxy.

* * * * *